United States Patent [19]

Ayer

[11] 4,085,992

[45] Apr. 25, 1978

[54] METHOD AND APPARATUS FOR CONNECTING MULTI-CONDUCTOR CABLES

[75] Inventor: George Edward Ayer, Endicott, N.Y.

[73] Assignee: Bunker Ramo Corporation, Oak Brook, Ill.

[21] Appl. No.: 664,125

[22] Filed: Mar. 5, 1976

Related U.S. Application Data

[62] Division of Ser. No. 448,476, Mar. 6, 1974, Pat. No. 3,958,850, which is a division of Ser. No. 248,595, Apr. 28, 1972, Pat. No. 3,820,056.

[51] Int. Cl.[2] ..... H01R 13/54

[52] U.S. Cl. ..... 339/91 R; 339/75 M

[58] Field of Search ..... 339/75 R, 75 M, 92 M, 339/91 R, 125 R, 22 B

[56] References Cited

U.S. PATENT DOCUMENTS

| | | | |
|---|---|---|---|
| 2,871,457 | 1/1959 | Jencks et al. | 339/75 M |
| 2,899,669 | 8/1959 | Johanson | 339/91 R X |
| 2,932,000 | 4/1960 | Buchanan | 339/125 R |
| 3,052,863 | 9/1962 | Uberbacher et al. | 339/75 M X |
| 3,110,538 | 11/1963 | Rees et al. | 339/92 M |
| 3,345,604 | 10/1967 | Henschen et al. | 339/75 M X |
| 3,566,336 | 2/1971 | Johnson et al. | 339/91 R |
| 3,617,985 | 11/1971 | Kehl | 339/92 M |

FOREIGN PATENT DOCUMENTS

| | | | |
|---|---|---|---|
| 737,662 | 9/1955 | United Kingdom | 339/75 M |

*Primary Examiner*—Roy Lake
*Assistant Examiner*—E. F. Desmond
*Attorney, Agent, or Firm*—William Lohff; F. M. Arbuckle

[57] ABSTRACT

Apparatus for connecting multi-conductor cables is provided, consisting of an assembly having at least three panels, one of which is a base plate and at least two of which have first connector elements mounted in them. The plates are joined to form an enclosure, preferably of a delta shape, for a first multi-conductor cable. Each of the first connector elements has a selected group of first cable conductors connected to it. There are a plurality of second connector elements which are adapted to mate with the first connector elements with each of the second connector elements being connected to a selected group of conductors of one or more second cables. Apparatus is provided which is operative when the connector elements are mated for preventing the elements from being accidentally separated, but for permitting the elements to be separated if desired.

5 Claims, 8 Drawing Figures

16
118
42
18
20
28
98
24
26
94
96
30
22
46
48
76
78
92
32
34
36
100
88
10
14

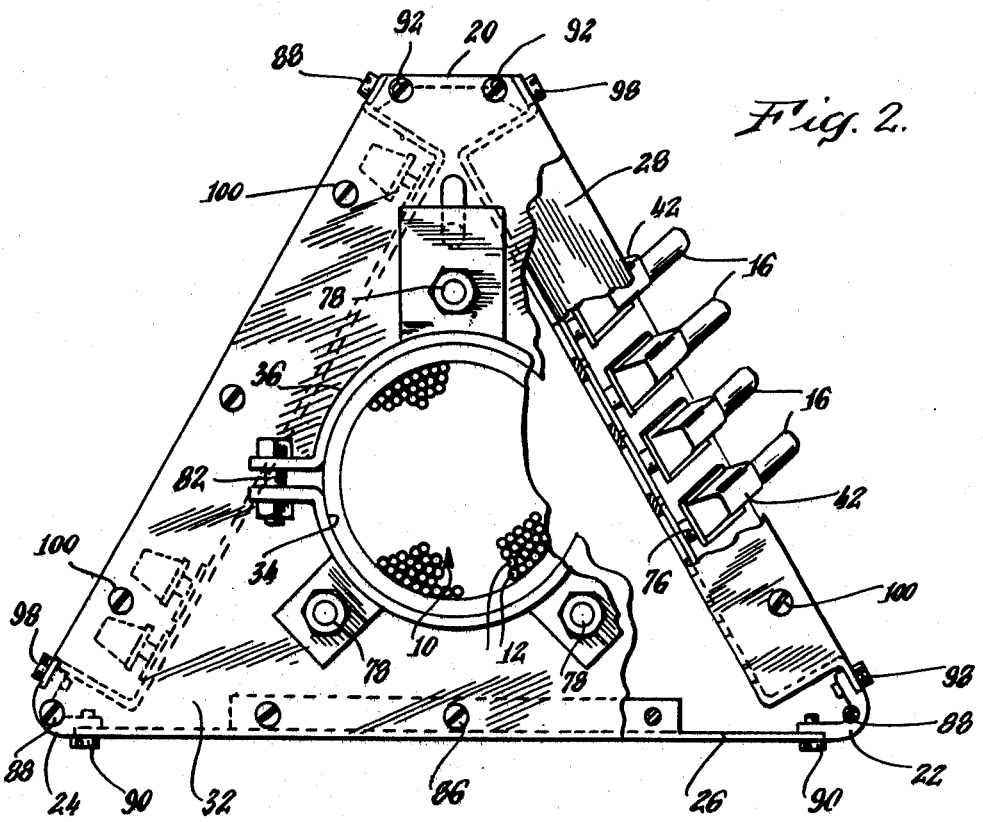
Fig. 2.
Fig. 3.
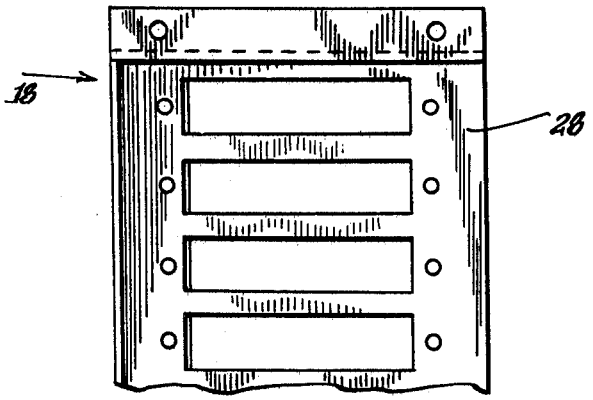

METHOD AND APPARATUS FOR CONNECTING MULTI-CONDUCTOR CABLES

This is a divisional application of application Ser. No. 448,476, filed Mar. 6, 1974, now U.S. Pat. No. 3,958,850 which is a divisional application of application Ser. No. 248,595, filed Apr. 28, 1972, now U.S. Pat. No. 3,820,056.

This invention relates to apparatus for connecting multi-conductor cables and more particularly to a modular assembly adapted for the connection of a first multi-conductor cable to one or more second multi-conductor cables.

BACKGROUND

There are numerous applications where a single large electrical cable is to be connected with a number of smaller cables. One such application is in a telephone office or large office building where the stub cables leading from a telephone switchboard are to be connected to a riser cable which is itself connected to cables bringing service to subscribers. The riser cable may have from 300 to 2700 twisted pairs of wires, or in other words up to 5400 wires. Present practice is to random splice by hand the stubs to the riser cable, an operation which can take a competent splicer up to 80 hours. Further, seven extra feet of wire is normally provided for each conductor for the splice operation. The resulting bundle of the spliced conductors is large, bulky and rather ugly and the entire bundle must be opened in order to make any change in a connection. A problem also exists in finding and identifying the connection to be changed in the bundle. In addition to the time indicated above for performing the splice operation, an additional 48 hours are normally necessary for test boarding the riser cable at the end which is connected to subscriber lines. The test boarding involves a ringing-out operation to identify the terminal at the switchboard end of the riser cable to which a given conductor at the subscriber-line end of the cable is connected.

From the above, it is apparent that the existing random-splice procedure requires a skilled craftsman and that significant time of such a craftsman is required for each operation. Further, the cable is normally dropped through a chamber or trap where working quarters are relatively tight, so that the extended period of time required to random-splice each cable results in significant congestion and confusion in the area and decreases the overall efficiency of the office operation.

It is therefore apparent that significant savings in time and money could be achieved if an acceptable substitute could be found for random splicing in the connecting of telephone or similar cables. Further savings could be achieved if the connection procedure were simplified to the point where the connections could be performed by semi-skilled rather than highly skilled technicians. Since space in an office is normally at a premium, the connection assembly should be as compact as possible. Further, since the cost per foot of a cable having, for example, 2400 twisted pairs is significant, the amount of extra wire required for the connection operation should be held to a minimum. Finally, the connecting device should provide a reliable, long-life connection which cannot work free or be otherwise spuriously broken, but which may be easily disconnected if desired and on which modifications may be performed easily without affecting the entire assembly.

SUMMARY OF THE INVENTION

This invention therefore provides an improved apparatus for connecting multi-conductor cables. An assembly is provided which consists of at least three panels. For the preferred embodiment of the invention, one of the panels is a base plate and the other two panels have first connector elements mounted in them. The plates are joined to form an enclosure, preferably of a generally delta shape, for a first multi-conductor cable. Each of the first connector elements has a selected group of the first cable conductors physically and electrically connected to it. There are a plurality of second connector elements which are adapted to mate with the first connector elements, with each of the second connector elements being physically and electrically connected to a selected group of conductors of one or more second cables. A means is also provided which is operative when a second connector element is mated in a corresponding first connector element preventing the elements from being spuriously separated, but permitting the elements to be separated if desired. Additional panels may be modularly added to the assembly to form an enclosure for cables having a greater number of twisted pairs.

The foregoing and other objects, features and advantages of this invention will be apparent from the following more particular description of a preferred embodiment of the invention as illustrated in the accompanying drawings.

BRIEF DESCRIPTION OF DRAWINGS

FIG. 2 is a partially cut-away rear view of the assembly shown in FIG. 1.

FIG. 3 is a top view of a portion of one connector mounting panel for the assembly shown in FIG. 1.

DETAILED DESCRIPTION

Figure 1:
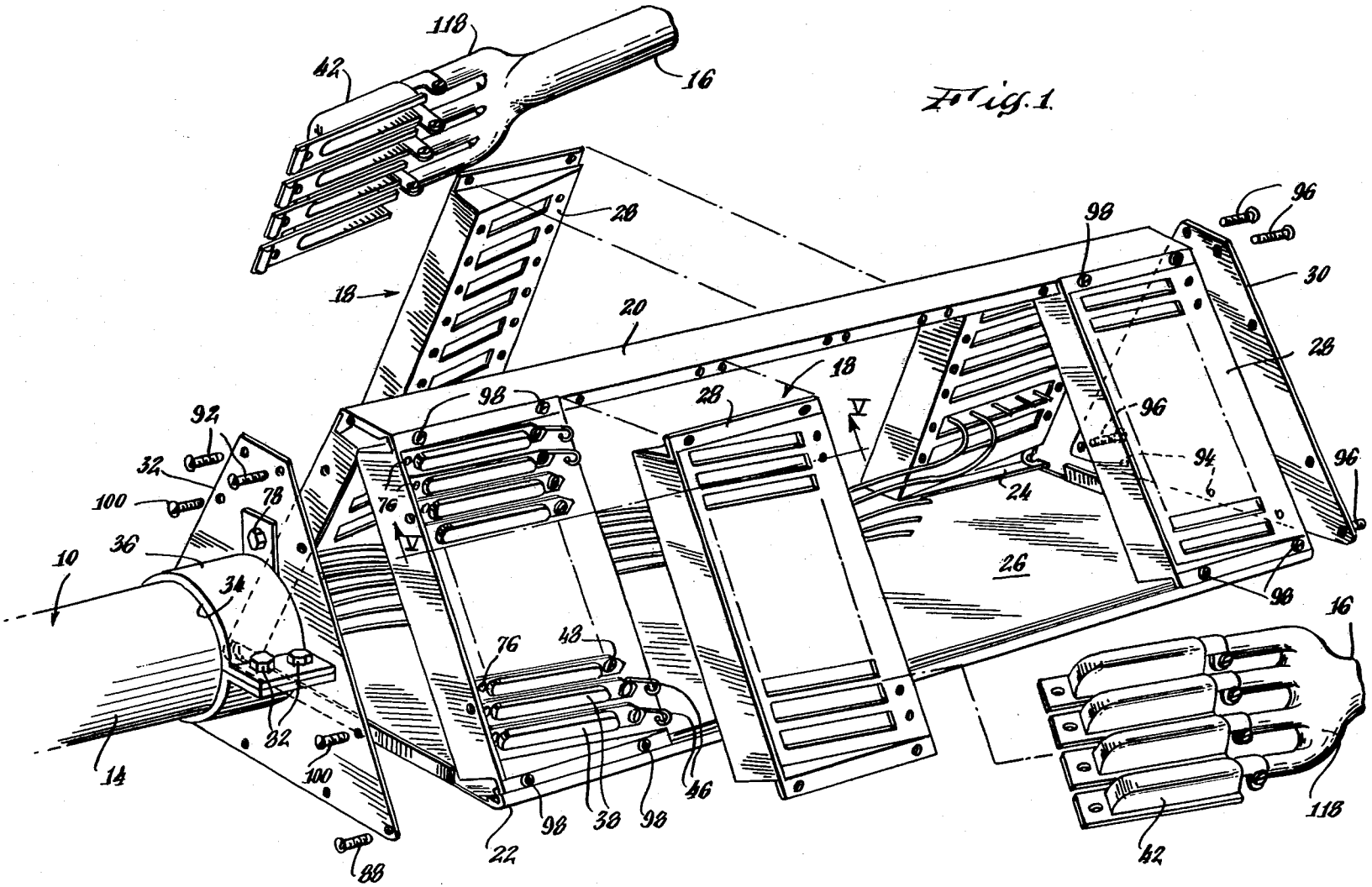
FIG. 1 is a partially exploded prospective view of a connector assembly of a preferred embodiment of the invention.

While the apparatus of this invention is suitable for use in a variety of applications, the following discussion will, for purposes of illustration, be with respect to the telephone cable application previously described. Referring now to the figures, a riser cable 10 having from 300 to 2700 twisted pairs of wires is shown. An end 12 of the cable is to be boarded for connection to, for example subscriber lines, while an end 14 of the cable is to be connected in a suitable manner to connector block cables 16. In the past, the connection of cables 10 and 16 has been effected by random splicing the conductors of each. In place of random splicing, this invention provides a delta-shaped junction box connector assembly enclosure 18. This assembly is formed with three extrusions or rails 20, 22, and 24 to which are secured a base plate or plates 26 and a suitable number of connector plates 28 for the size cable being terminated. The enclosure is sealed at the end opposite the cable by end plate 30 and at the cable end by plate 32 having a cable receiving opening 34 formed therein. A clamp assembly 36 is mounted on cable 10 and secured to end plate 32 with bolts and nuts 78.

Figure 4:
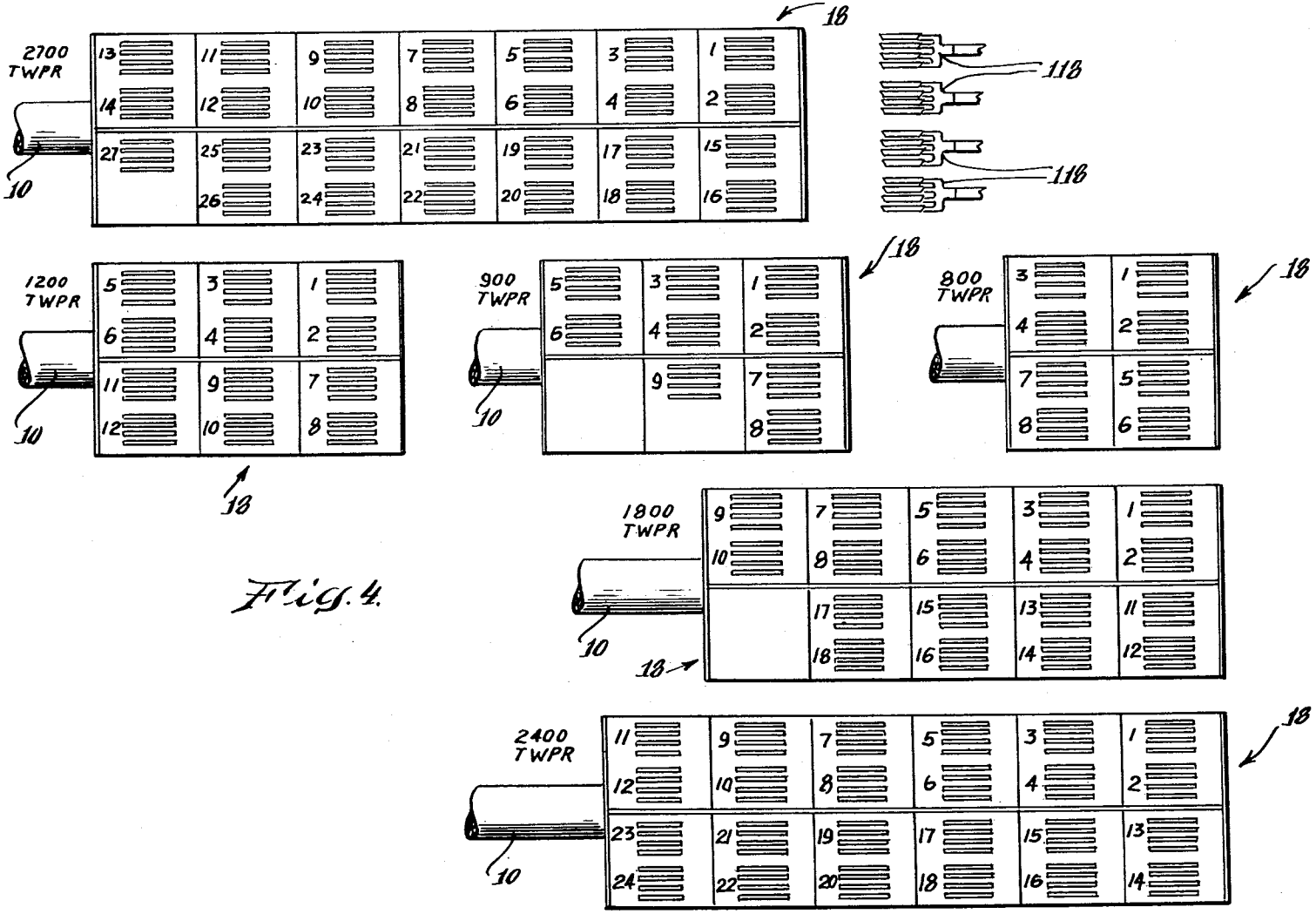
FIG. 4 is a diagrammatic top view of assemblies illustrating the arrangement of connector elements and bunch assignments for various different sizes of cable.

Each plate 28 has a plurality of ribbon-type connector elements 38 mounted in it. For a preferred embodiment of the invention, Amphenol 57 series connectors are utilized, with each connector having 25 pairs of ribbon contacts. Since, for the preferred embodiment, there are eight connector elements 38 mounted in each plate 28, each plate may accommodate up to 200 twisted pairs of conductors. In practice, the conductors of a multi-conductor cable are grouped into bunches which are color coded for identification and are arranged in a predetermined order. Each bunch normally contains 100 twisted pairs of wire. It is therefore apparent that, as shown in FIG. 1, four connector elements 38 are required for for each conductor bunch. FIG. 4 illustrates the connector elements to which each conductor block of the cable is connected for cables of various typical sizes. From FIG. 4 it is thus seen that the enclosure of this invention is totally modular, permitting a greater or lesser number of connector elements to be utilized as required for different cable sizes. This is accomplished by changing the lengths of rails 20, 22 and 24, either changing the length of or adding additional plates 26, and by adding additional plates 28.

Referring still to FIG. 1, each connector block cable 16 also has 100 twisted pairs of conductors. Each of these cables is terminated by four connector elements 42 which are of a type to mate with connector elements 38. For a preferred embodiment of the invention these are Amphenol 57 series blue ribbon-type connectors.

Figure 5:
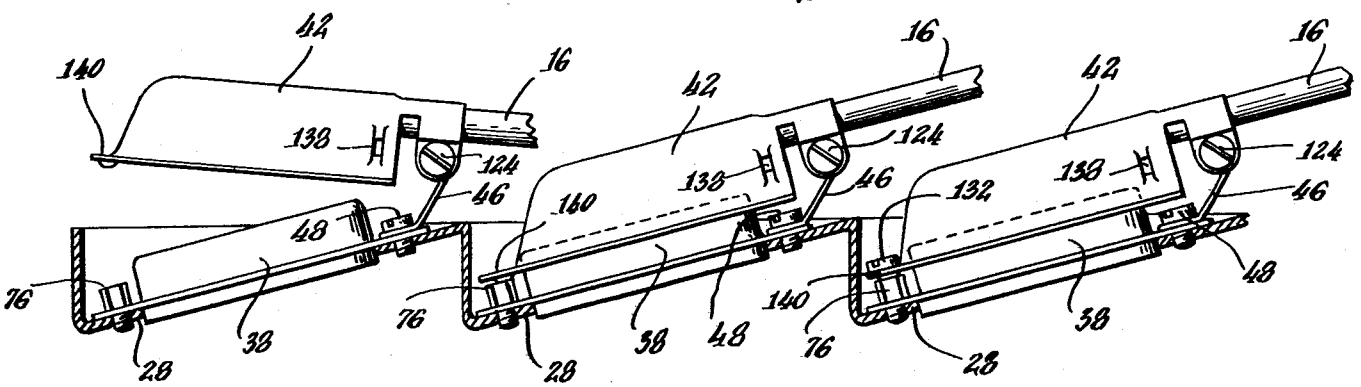
FIG. 5 is a section view along the line 5—5 of FIG. 1 illustrating the various stages in the operation of securing the connector elements together for a first embodiment of the invention.
Figure 6:
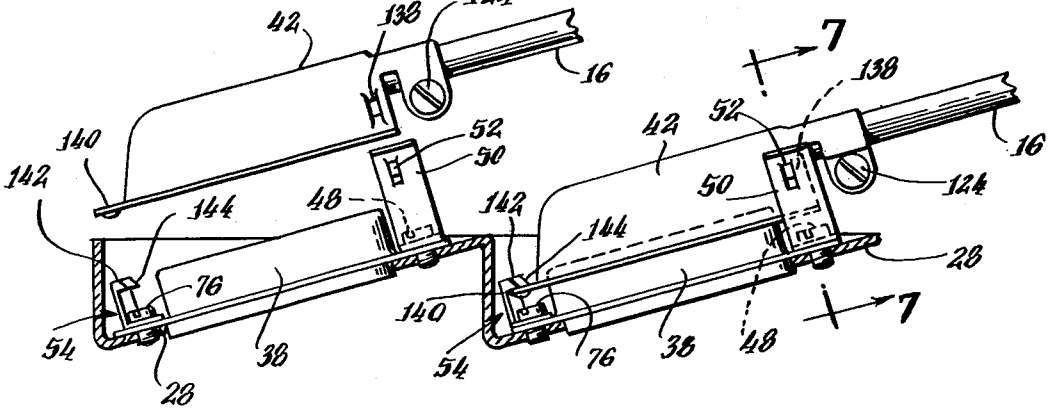
FIG. 6 is a view along the line 5—5 of FIG. 1 illustrating the various steps in the operation of securing the connector elements together for a second embodiment of the invention.
Figure 7:
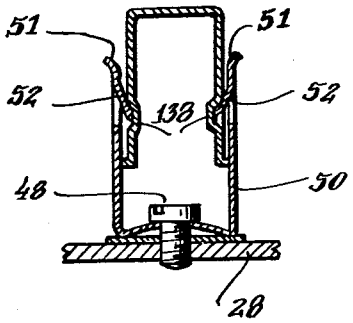
FIG. 7 is a sectional view along the line 7—7 of FIG. 6.
Figure 8:
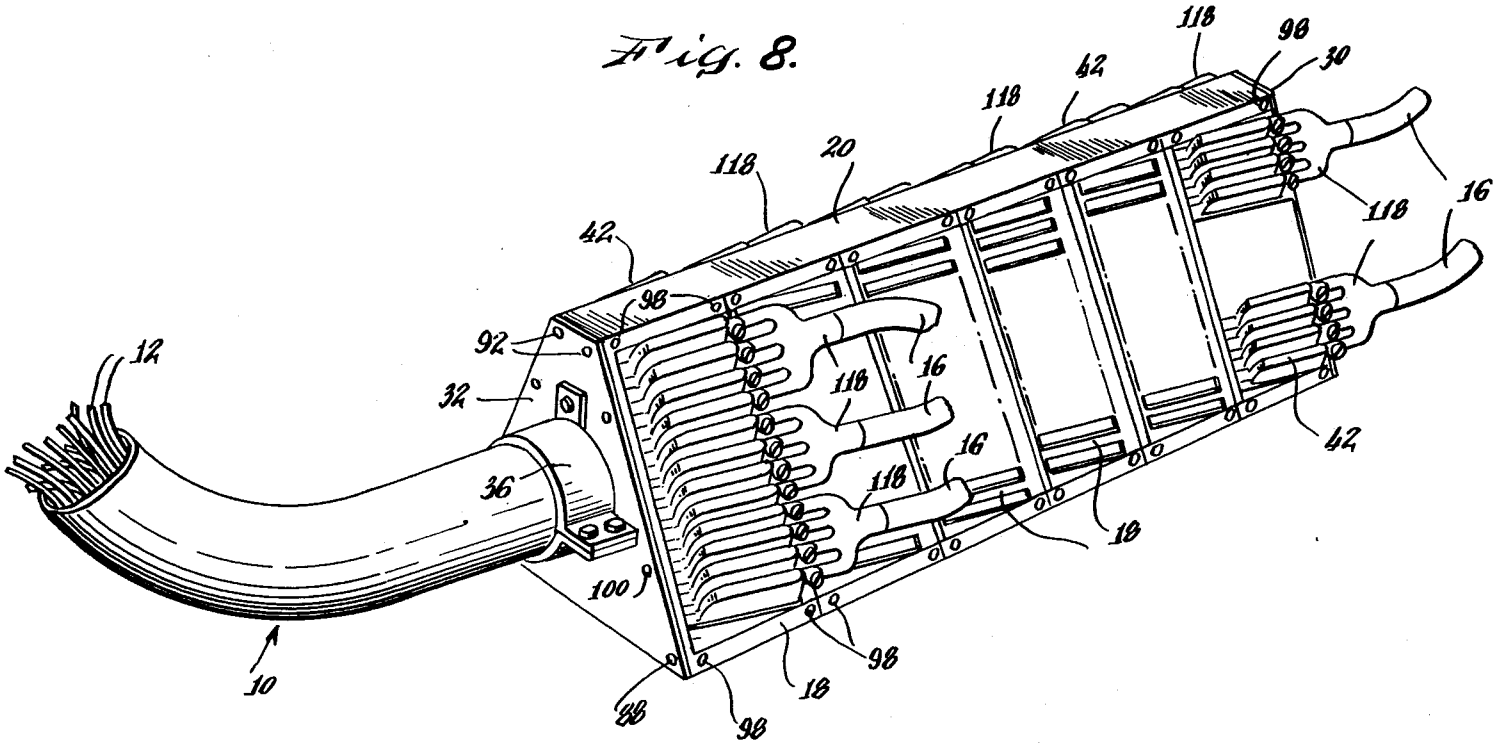
FIG. 8 is a perspective view showing the connector assembly of FIG. 1 fully assembled.

For the embodiment of the invention shown in FIGS. 1, 2, and 4, a holddown clip 46 shown in FIGS. 1 and 5 is secured adjacent each connector element 38 by one of the screws 48 which is utilized to hold the connector in place. As will be described in greater detail later, holddown 46 is utilized to secure a mating connector element pair (38, 42) against accidental disconnection. FIGS. 6 and 7 illustrate an alternative mechanism for preventing the spurious separation of the connector elements. This mechanism includes a "U" shaped clip 50 having anchor projections 52 which is secured near the rear end of each connector element 38, and a spring clip 54 which is secured near the tip of each connector element. The manner in which these clips are utilized to secure a pair of mating connectors against accidental separation will be described shortly.

Where connector halves are to be secured together in accordance with the embodiment of the invention shown in FIG. 5, hold down clips 46 are initially secured to enclosure 18. While this may be done in the field, it is preferably done as part of the connector assembly operation. Referring now to FIG. 5, the first step in the field connection of a cable 16 to a cable 10 is to connect each connector element 42 to the holddown clip 46 of the corresponding mating connector element 38 with a strain relief screw 124. The appearance of the assembly after this step in the operation has been completed is illustrated by the left-most pair of connector elements in FIG. 5; connector element 42 is pivoted into engagement with connector element 38. The appearance of the connector pair after this step in the operation has been completed is shown by the middle connector in FIG. 5. The final step in the operation involves the turning of a screw 132 which is inserted through an opening in the case of connector element 42 either at this time or during the assembly operation to secure connector 42 to stand-off element 76. These steps are repeated for each connector pair. To disconnect the cables, the operations performed are reversed.

FIGS. 6 and 7 illustrate an alternative holddown mechanism which permits connections to be effected more rapidly than with the embodiment of the invention shown in FIG. 5. However, with this embodiment of the invention, it is slightly more difficult to separate the connector elements when such is desired. With this embodiment of the invention, clips 50 and 54 are attached adjacent each connector element 38. Screw 48 and a screw in place of stand-off 76 may be used for attaching clips 50 and 54 respectively.

When a pair of connector elements 38 and 42 are to be mated with this embodiment of the invention, the connector elements are first positioned as shown for the left-hand connector pair in FIG. 6 and pressure is then applied to the top of connector element 42 to force the connector elements together. As this is done, the sides of the connector casing, which lie in a plane parallel to the direction in which the connector element moves when being mated, act on cam projections 52 to open clip 50, the upright portions of which extend along the sidewalls of the casing. When the connectors are fully mated, projections 52 drop into openings 138 in the side of the connector casing to lock the back portion of the connector elements together. At the same time that this is occurring, projecting tip 140 of the connector element casing bears against cam surface 142 of clip 54 pushing the clip back to permit tip 140 to pass in front of it. When the connector elements are completely seated, tip 144 of clip 54 snaps back over the projection 140 to lock the front end of the connector elements together. FIG. 7 and the right hand portion of FIG. 6 show the elements as they appear when fully seated. A clip of suitable size having the shape of clip 50 may be substituted for clip 54 if desired.

To separate the connector elements once they have been mated, clip 54 is pushed back and tip 140 raised slightly so as to no longer be engaged by the clip. The cam surfaces of the clip 50 extend outwardly, as seen in FIG. 7, making it convenient to insert a suitable tool between the sides of clip 50 and the sides of the connector element, wedging the sides of the clip out to remove projections 52 from holes 138. When this is done, connector element 42 may be pulled out of engagement with connector element 38.

As was indicated previously, the present random-splice technique requires approximately 80 hours of skilled technician time to connect a single riser cable, plus the time required for the ringing-out operation which may be another 24 hours. By contrast, the corresponding operations, utilizing the apparatus of this invention, may be completed in from 4 to 8 hours by a somewhat less skilled operator. With the embodiment of the invention shown in FIGS. 6 and 7, the time required may be reduced even further. In addition, since the ringing-out operation is performed at the factory, the 24 hours required for this operation is also eliminated further reducing the field time and labor required. A neat, easy to operate upon, and modularly expandable assembly is thus provided. It has been found that the size of the package is roughly half of that required with the random splicing operation.

What is claimed is:

1. An assembly for physically and electrically connecting a first multi-conductor cable to a plurality of second multi-conductor cables, comprising:

at least three panels;

connecting means for joining said panels to form an enclosure for said first cable;

a plurality of first connector elements mounted in at least one of said panels, each of said connector elements having a selected group of first cable conductors physically and electrically connected thereto;

a plurality of second connector elements adapted to mate with said first connector elements, each of said second connector elements being physically and electrically connected to a selected group of conductors of said second cables; and releasable engagement means operative when a second connector element is mated in a corresponding first connector element for preventing the elements from being spuriously separated but for permitting them to be separated if desired, said releasable engagement means including a holddown secured at one end of the first connector element and at the other end to a point near one end of the second connector element, and a screw securing a point near the other end of the second connector element to said panel.

2. An assembly for physically and electrically connecting a first multi-conductor cable to a plurality of second multi-conductor cables, comprising:

at least three panels;

connecting means for joining said panels to form an enclosure for said first cable;

a plurality of first connector elements mounted in at least one of said panels, each of said connector elements having a selected group of first cable conductors physically and electrically connected thereto;

a plurality of second conductor elements adapted to mate with said first connector elements, each of said second connector elements being physically and electrically connected to a selected group of conductors of said second cables; and releasable engagement means operative when a second connector element is mated in a corresponding first connector element for preventing the elements from being spuriously separated but for permitting them to be separated if desired, each of said second connector elements having lateral sidewalls with openings therein, and said releasable engagement means including at least one clip having cam means permitting the second connector element to enter the clip during the connector element mating operation, and a pair of surfaces engaging respective ones of the openings in the sidewalls of the second connector element to prevent its removal from the clip when the connector elements have been mated.

3. An assembly of the type set forth in claim 2, wherein said clip is a U-shaped member of a springy material having projections formed on its inner surfaces which coact with the second connector element to cam the sides of the clip out of the way during the mating of the connector elements and to hold the second connector element in place when the connector elements are mated.

4. An assembly for physically and electrically connecting a first multi-conductor cable to a plurality of second multi-conductor cables, comprising:

at least three panels;

connecting means for joining said panels to form an enclosure for said first cable;

a plurality of first connector elements mounted in at least one of said panels, each of said connector elements having a selected group of first cable conductors physically and electrically connected thereto;

a plurality of second connector elements adapted to mate with said first connector elements, each of said second connector elements being physically and electrically connected to a selected group of conductors of said second cables; and releasable engagement means operative when a second connector element is mated in a corresponding first connector element for preventing the elements from being spuriously separated but for permitting them to be separated if desired, said releasable engagement means comprising a plurality of U-shaped clips, each having a base and two sides, each of said clips being attached to said panel at its base adjacent one end of the respective first element, the sides of said clip extending adjacent opposite sides of said first element, and respective projections in each side of said clip extending toward the adjacent side of said first element, and detent means in the sides of said second elements so positioned as to be engageable with said projections on the sides of said clip when a first and second element are fully mated, whereby said elements are releasably retained in mated relation.

5. An assembly of the type set forth in claim 4, wherein said releasable engagement means further comprises:

a plurality of holddown members each attached adjacent the other end of a respective first connector element; and means on each of said second connector elements engageable in retaining relation with a respective one of said holddown members when a first connector element and a second connector element are in fully mated relation.

* * * * *